US007004799B2

(12) United States Patent
Ladin et al.

(10) Patent No.: US 7,004,799 B2
(45) Date of Patent: Feb. 28, 2006

(54) HIGH TEMPERATURE INHIBITOR MATERIAL AND METHODS OF MAKING AND USING THE SAME

(75) Inventors: Dmitry Ladin, Toronto (CA); Rudy Bukovnik, Chapel Hill, NC (US); Milenko Braunovic, Montreal (CA)

(73) Assignee: Tyco Electronics Corporation, Middletown, PA (US)

( * ) Notice: Subject to any disclaimer, the term of this patent is extended or adjusted under 35 U.S.C. 154(b) by 88 days.

(21) Appl. No.: 10/348,420

(22) Filed: Jan. 21, 2003

(65) Prior Publication Data

US 2004/0142604 A1 Jul. 22, 2004

(51) Int. Cl.
*H01R 9/24* (2006.01)
*H01R 13/02* (2006.01)

(52) U.S. Cl. ..... 439/886

(58) Field of Classification Search ..... 439/886, 439/783, 887, 893

See application file for complete search history.

(56) References Cited

U.S. PATENT DOCUMENTS

| | | | | |
|---|---|---|---|---|
| 3,250,808 | A * | 5/1966 | Milian, Jr. et al. | 562/586 |
| 3,696,128 | A * | 10/1972 | Garth | 552/262 |
| 4,891,394 | A * | 1/1990 | Savin | 523/442 |
| 5,061,566 | A * | 10/1991 | Morgan | 428/423.1 |
| 5,284,888 | A * | 2/1994 | Morgan | 524/93 |
| 5,549,835 | A * | 8/1996 | Uematsu et al. | 508/204 |
| 5,773,394 | A * | 6/1998 | Wan et al. | 508/591 |
| 2002/0177646 | A1 * | 11/2002 | Field | 524/430 |

FOREIGN PATENT DOCUMENTS

| | | | |
|---|---|---|---|
| DE | 10063886 | A1 | 6/2002 |
| WO | WO 02/06375 | A2 | 1/2002 |

OTHER PUBLICATIONS

Akin, Kevin D., "Using Connector Lubricants for Warranty Reduction," http://www.nyelubricants.com/techarticles/index.htm.

Antler, Morton, "The Lubrication of Gold," *Wear*, 6 44-65 (1963).

Antler, Morton, "Electrical Effects of Fretting Connector Contact Materials: A Review," *Wear*, 106 5-33 (1985).

Braunovic, Milenko, "Evaluation of Different Types of Contact Aid Compounds for Aluminum-to-Aluminum Connectors and Conductors," *IEEE Transactions on Components, Hybrids, and Manufacturing Technology*, CHMT-8(3) 313-320 (Sep. 1985).

Braunovic, Milenko, "Effect of Different Types of Mechanical-Contact Devices on the Performance of Bolted Aluminium-to-Aluminium Joints Under Current Cycling and Stress Relaxation Conditions," *IEEE*, CH2236-8(86) 133-141 (1986).

Braunovic, Milenko, "Evaluation of Different Contact Aid Compounds for Aluminum-to-Copper Connections," *IEEE Transactions on Components, Hybrids, and Manufacturing Technology*, 15(2) 216-224 (Apr. 1992).

Braunovic, Milenko, "Further Studies of Different Contact Aid Compounds for Aluminum-to-Copper Connections," *IEEE*, 53-62 (1999).

(Continued)

*Primary Examiner*—Chandrika Prasad
(74) *Attorney, Agent, or Firm*—Myers Bigel Sibley & Sajovec

(57) ABSTRACT

High-temperature inhibitor materials for use with electrical connections in energy transmission and distribution systems where operating temperatures exceed 150° C. The high-temperature inhibitor materials comprise base oils and conductive particles, wherein the high-temperature inhibitor is stable at temperatures above 150° C.

59 Claims, 1 Drawing Sheet

OTHER PUBLICATIONS

Kawakami et al., "Properties of Heat-Resistant Aluminum-Alloy Conductors for Overhead Power-Transmission Lines," *Furukawa Review*, 9 81-85 (1991).

Noël et al., "Electrical and Tribological Properties of Hot-Dipped Tin Separable Contacts with Fluorinated Lubricant Layers," *IEEE*, 225-235 (1999).

Noël et al., "Lubrication Mechanisms of Hot-Dipped Tin Separable Electrical Contacts," *IEEE*, 197-202 (2001).

"Anti-Seize," http://www.loctite.com/catalog/category1.html?ProductLine=9090.

Gagnon et al. "High Temperature Lubricants for Power Connectors Operating at Extreme Conditions," IEEE 273-282 (2002).

PCT Invitation to Pay Additional Fees corresponding to PCT/US2004/001444, mailed on Jun. 9, 2004.

* cited by examiner

HIGH TEMPERATURE INHIBITOR MATERIAL AND METHODS OF MAKING AND USING THE SAME

FIELD OF THE INVENTION

This invention relates to materials for protecting surfaces in electrical systems, and more particularly to inhibitor materials and methods of fabricating and using the same in electrical systems.

BACKGROUND OF THE INVENTION

The power industry is deregulating. As the monopolistic economic model of the old power industry shifts to a new, competitive market, the electric utilities are increasingly focusing on their existing infrastructure with an eye to prolonging its operational lifespan. At the same time, strains on the power supplies are increasing. Cities are becoming more populated and energy consumption in densely populated areas is increasing. Customers are also demanding better, and cheaper, energy. The demands for increased amounts of energy at lower costs can strain the existing electrical transmission and distribution systems.

For example, the existing electric utility infrastructure is forced to carry greater loads in the energy transmission and distribution systems to compensate for the increased energy demands. As a result of the increased loads, more energy is transmitted, raising the operating temperatures at which the materials and components in the energy transmission and distribution systems operate. However, portions of the existing transmission and distribution systems are not designed to operate at the higher operating temperatures more frequently encountered by today's electrical utilities. Therefore, the electrical utilities are implementing necessary plant upgrades as well as energy transmission and distribution system upgrades while keeping an eye on cost control.

Aware of the need to provide new electrical transmission and distribution systems capable of handling increased energy loads and the higher temperatures resulting therefrom, cable and wire manufactures have developed a high temperature conductor designed for overhead distribution and transmission lines called, aluminum conductor, steel supported (ACSS). ACSS is designed to operate continuously at elevated temperatures without loss of strength. For example, different ACSS products are designed to operate at temperatures around 200° C., and even up to 250° C. in some cases. These operating temperatures are higher than the 130° C. operating temperature designs found in many of the existing conductors. ACSS is also designed to sag less than other existing conductors under emergency electrical loadings, which are becoming more common with increased energy demands imposed on the energy transmission and distribution systems.

Although the ACSS technology provides cost-effective alternatives for the electric utilities to upgrade and repair energy transmission and distribution systems, advances in other technologies that must work with the ACSS have not kept pace with the advances made by ACSS. Of particular concern are power connections. Power connections are generally the weak links in an energy transmission and distribution system. Unless the stability and performance of the power connections meets or exceeds the operating conditions of the ACSS, the full potential of ACSS may not be realized.

For instance, wedge technology provides reliable connector technology for use in non-tension power applications and power connections. A basic wedge device 100 as used in energy transmission and distribution systems is illustrated in FIG. 1. The wedge device includes a "C" member 110 and a wedge member 120. The "C" member 110 may encompass portions of two conductors 130A and 130B or a conductor 130A and a device (not shown) in communication with the conductor 130A. The wedge member 120 is positioned within the "C" member 110 to form an electrical connection between the two conductors 130A and 130B or to electrically connect conductor 130A with a device (not shown). Typically, an inhibitor material is applied to the "C" member 110 and the wedge member 120, and optionally the conductors 130A and 130B, to inhibit oxidation of the wedge device 100 and protect the wedge device 100 from exposure to the elements. The partial covering of the wedge device 100 with an inhibitor material can have a beneficial effect on the performance of the wedge device 100 and may improve the lifetime of the wedge device 100. The use of inhibitor materials with other connector technologies and power connections may be beneficial for similar reasons.

Oil based inhibitor materials are frequently used with power connections in energy transmission and distribution systems to provide benefits such as improved corrosion resistance, sealing properties, elemental protection, and/or reduced wear on the power connection. However, existing inhibitor materials do not posses the temperature stamina required for operation with ACSS or the high temperatures frequently associated with the increased loading or emergency loading of existing energy transmission and distribution systems. Under such high temperature conditions, existing inhibitors tend to transform into a congealed varnish and do not provide the desired protective benefits. There are apparently no inhibitor materials available that are capable of retaining the desired sealing properties or providing the corrosion resistance and protection to power connections operating at the high-temperatures associated with the ACSS technology, for instance, between 150° C. and 250° C. Therefore, it is desirable to develop, fabricate, and use an inhibitor material capable of operating at high-temperatures, or a material exhibiting inhibitor properties, with energy transmission and distribution systems.

SUMMARY OF THE INVENTION

Embodiments of the present invention provide materials that exhibit desired inhibitor properties for energy transmission and distribution systems at high-temperatures, for instance, temperatures between 150° C. and about 250° C. Other embodiments of the present invention provide methods of fabricating such materials and using those materials with energy transmission and distribution systems.

In some embodiments of the invention, a high-temperature inhibitor material comprises a base oil, which is capable of operating at temperatures of at least 150° C., mixed with metal particles. Base oils capable of operating within the desired temperature range above 150° C., and in some instances between 150° C. and about 250° C., without breaking down may be used. Combinations of base oils may also be mixed together to form a base oil for use with embodiments of the present invention. A thickener may also be added to the base oil, for example, to alter the viscosity of the base oil and the inhibitor. Metal particles mixed with base oil may comprise metal powder, metal filings, metal pieces, or the like. In some embodiments, the metal particles may have standard mesh sizes between about −80 and about +200. The metal particles may also be conductive, for instance, comprising aluminum, nickel, or aluminum-nickel alloys. In other embodiments, the metal particles may be substituted with and/or mixed with abrasive particles, such as metal oxides or other non-metallic particles.

Metal particles may be mixed with base oils according to embodiments of the present invention by hand or by mechanical means. In some embodiments, the base oil and metal particles are mixed together in a ratio such that the base oil is about 90 percent by weight of the inhibitor material and the metal particles are about 10 percent by weight of the inhibitor material. In other embodiments, the base oil is about 70 percent or more by weight of the inhibitor material and the metal particles are about 30 percent or less by weight of the inhibitor material. In other embodiments, an inhibitor may include up to about 30 percent by volume metal particles, non-conductive particles, and/or non-metallic particles. Other mixture ratios may also be used depending upon the desired use for the inhibitor material.

In other embodiments of the invention, a component for use in a high-temperature energy transmission and distribution system is provided with a partial or complete coating of an inhibitor of the present invention. For instance, a wedge device is at least partially coated with an inhibitor according to embodiments of the present invention and provided for distribution and use with an energy transmission and distribution system exhibiting temperatures above 150° C. Alternatively, an inhibitor according to embodiments of the present invention may be provided for application to electrical components or devices in use or being prepared for use in energy transmission and distribution systems operating at temperatures higher than conventional energy transmission and distribution systems, for instance between 150° C. and about 250° C.

Other embodiments of the present invention comprise methods of inhibiting corrosion in an electrical connection or device. According to these embodiments, an inhibitor capable of operating at temperatures above 150° C. may be applied to an electrical connection to inhibit corrosion thereof. The inhibitor may comprise one or more base oils mixed with metal particles.

In some other embodiments of the present invention, an electrical connection kit is provided. The electrical connection kit may comprise a electrical connection element and an inhibitor wherein the inhibitor comprises a base oil capable of operating at a temperature above 150° C. mixed with metal particles.

DETAILED DESCRIPTION OF THE INVENTION

Figure 1:
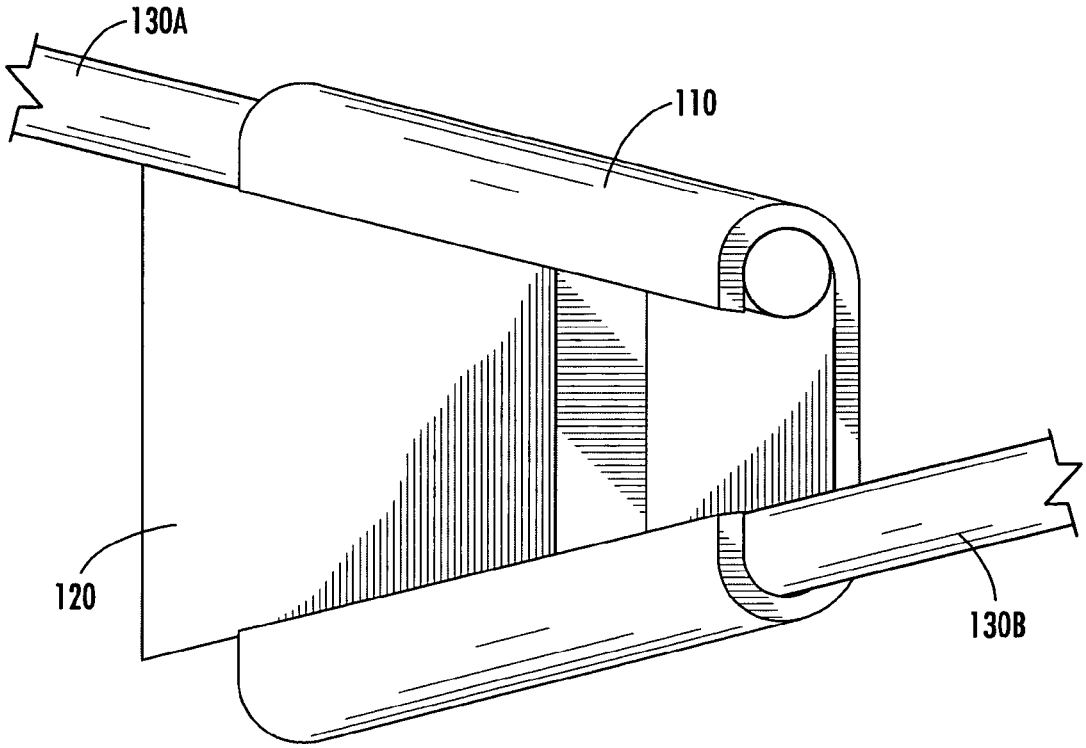
FIG. 1 illustrates a wedge device commonly used with power connections and electrical connections as known in the art.

The present invention now will be described more fully hereinafter with reference to the accompanying drawing. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness and size of the devices are exaggerated for clarity.

This invention relates to materials for protecting contact surfaces in electrical systems, and more particularly to materials, such as inhibitor materials, and methods of fabricating and using the same in electrical systems. Embodiments of the present invention provide inhibitors for use with high-temperature energy transmission and distribution systems and methods of fabricating and using the same. High-temperature energy transmission and distribution systems include energy transmission and distribution systems capable of operating at temperatures above 150° C. and, in some embodiments, capable of operating between 150° C. and about 250° C.

Energy transmission and distribution systems commonly employ power connections or electrical connections for facilitating the distribution of energy through power lines or conductors. Electrical connections may include devices such as connectors, switches, junctions, and the like, commonly used to connect and operate energy transmission and distribution systems. Lubricants are often used with the electrical connections to provide lubrication for the electrical connection devices. Special classes of lubricants, commonly referred to as inhibitors, may be applied to electrical connections and/or conductors. Inhibitors may be used to inhibit corrosion and/or oxidation of the electrical connections and/or conductors; to improve electrical contact between different electrical connections and/or conductors; and/or to seal electrical connections from environmental exposure. Although inhibitors designed to operate at temperatures at or below about 130° C. are currently used, new high-temperature conductors being employed in the energy transmission and distribution systems may require inhibitors that are able to withstand temperatures above 150° C. during continuous operation, and in some cases inhibitors that are able to withstand temperatures between 150° C. and about 250° C. Inhibitors capable of operating during emergency overloading temperature spikes up to about 320° C. or more are also desirable. Embodiments of the present invention provide lubricants and inhibitors that meet or exceed the high-temperature requirements of the new conductors, such as ACSS, enabling the use of existing electrical connection equipment with the new conductors and high-temperature energy transmission and distribution systems.

Various embodiments of the present invention comprise inhibitors for use in energy transmission and distribution systems operating at high-temperatures. High-temperature operation of energy transmission and distribution systems includes operating temperatures between 150° C. and about 250° C. during normal continuous operation. At times, high-temperature operation of energy transmission and distribution systems may experience overloading and temperature spiking that will increase the operational temperatures of the energy transmission and distribution system above 250° C., for example, to about 320° C. or more. Inhibitors of embodiments of the present invention include base oils capable of withstanding continuous operating temperatures above 150° C. and occasional temperature spikes of 320° C. or more. A stable base oil or inhibitor according to some embodiments of the present invention does not readily flow out of or away from the contact zone to which it is applied when exposed to high-temperature operating conditions, for instance, operating temperatures between 150° C. and about 250° C. or more.

In some embodiments of the present invention, an inhibitor comprises a base oil and a metal mixed and/or suspended in the base oil. The base oil may include various base oils capable of withstanding temperatures above 150° C. For instance, the base oil may comprise any one of, or any combination of, a fluorinated base oil, a fluorinated ether, a perfluoroalkylether and/or a perfluoropolyether. In various embodiments, the base oil is designed for use in high-temperature applications and particularly for use at temperatures ranging between 150° C. and about 250° C. In other embodiments, the base oil may be designed for use in applications above 250° C. or more, for instance, applications prone to temperature spikes of 320° C. or more. In some embodiments, a thickener may be added to the base oil. The thickener may alter the viscosity of the inhibitor, for instance, making the inhibitor more viscous.

In other embodiments of the present invention, the base oil comprises fluorinated base oil. The fluorinated base oil may comprise various fluorinated compounds as will be understood by those skilled in the art, for example, fluorinated ether, perfluoroalkylethers, and/or perfluoropolyethers.

An example of a high-temperature base oil that may be used with embodiments of the present invention is Nye UniFlor® 8623 fluoroether-based lubricating grease. UniFlor® 8623 is available from Nye Lubricants, Inc. of Fairhaven, Mass. UniFlor® 8623 is a smooth white grease that is insoluble in water, inert, and stable at room temperatures. UniFlor® 8623 does not appear to break down under high-temperature operation and exhibits an operational temperature range (i.e. is stable at) between about −15° C. and about 250° C. Other commercially available high-temperature greases and lubricants offered by Nye Lubricants, Inc. may also be used with embodiments of the present invention.

Another example of a high-temperature base oil that may be used with embodiments of the present invention is a base oil formed from the mixture of a perfluoroalkylether with a thickener. A polydimethyl siloxane treated amorphous fumed silica may act as a thickener for the base oil. In this example, the inhibitor comprises about 85.7 percent by weight perfluoroalkyether mixed with about 4.3 percent by weight polydimethyl siloxane treated amorphous fumed silica, and about 10 percent by weight metal particles. This inhibitor has a density of about 16 lbs/gal and exhibits an operational temperature range between about −40° C. and about 260° C. Other weight percent combinations of perfluoroalkylethers with polydimethyl siloxane treated amorphous fumed silica may be used to form the base oil of inhibitors according to the present invention.

The metal particles of the inhibitors of embodiments of the present invention may include various types of metals. In some embodiments, the metal particles are mixed with and/or suspended in the base oils. The metal particles may be conductive and/or capable of providing the inhibitor with an abrasive quality. The metal particles may include metal powders, metal filings, metal pieces, and/or metal particles. In some embodiments of the invention, spherically shaped metal particles are used alone and/or in combination with other shapes of metal particles. The size of the metal particles utilized with embodiments of the present invention may vary from about −80 standard mesh size to about +200 standard mesh size. Many metals may be used with embodiments of the present invention, including, but not limited to, nickel, aluminum, lead, tin, bismuth, alloys of any of the foregoing metals, and mixtures thereof. For instance, the metal particles may comprise metal particles of a substantially electrolytic grade nickel. Alternatively, the metal particles may comprise virgin aluminum metal, recycled aluminum metal, or a mixture of virgin aluminum and recycled aluminum metal. Other suitable metal particles may be added to an inhibitor as desired to provide the desired conductive and/or abrasive qualities for the inhibitor.

It is understood that metals other than nickel, aluminum, lead, tin, bismuth or alloys thereof may be used as metal particles for mixing with base oils to form inhibitors according to the present invention. In other embodiments of the invention, non-metallic particles and/or non-conductive particles may be used in place of and/or in combination with, the metal particles of the inhibitor. Particles capable of providing conductive properties and/or abrasion properties for inhibitors of embodiments of the present invention may be mixed and/or added to the inhibitors. For instance, oxide particles and/or alumina particles may be added to inhibitors of the present invention.

The metal particles and/or other particles mixed with the base oils in embodiments of the present invention may provide a number of desirable characteristics to the inhibitor material. The conductive nature of the particles added to the inhibitor may improve one or more of the inhibitor's conductive qualities, which may provide improved electrical connections between connectors or conductors coated with the inhibitors of embodiments of the invention. In some embodiments, the particles provide the inhibitors with an abrasive material or abrasive quality. When applied to a conductor or a connector, the abrasiveness of the inhibitor may scrub away and/or abrasively remove oxidation on the conductor or connector. This is especially true in those instances where a conductor or connector is in contact with another conductor or connector. Stress, strain, and/or sheering forces between electrical interfaces using the inhibitor can create abrasion between the interfaces, abrading and dispersing oxides, thereby increasing metal-to-metal contact between the electrical interfaces.

An example of a metal particle mixture that may be mixed with a base oil to form an inhibitor according to embodiments of the present invention comprises a mixture of particles of nickel and aluminum. The metal particle mixture comprises about 48 to about 52 percent by weight nickel and about 48 to about 52 percent by weight aluminum. The nickel may include electrolytic grade nickel and the aluminum may include virgin aluminum. The metal particle mixture is mixed with a base oil according to embodiments of the invention to form an inhibitor comprising about 10 percent by weight metal particles and about 90 percent by weight base oil. The metal particle mixture may be mixed with the base oil by various methods, such as by hand or by mechanical means. Optionally, the metal particle mixture may be mixed with the base oil during the fabrication of the base oil.

In various embodiments of the invention, the amount of metal particles and/or other particles included in the inhibitors of the present invention may vary. For instance, the base oil and/or oils may be from about 70 to less than about 100 weight percent of the inhibitor and the metal and/or other particles may be from above about 0 to about 30 weight percent of the inhibitor. In some instances, it may be desirable to include more than 30 (e.g., 40 or 50) percent by weight of metal and/or other particles in the inhibitors of the present invention. In still other embodiments, the amount of metal and/or other particles added to the inhibitor may be up to about 30 percent by volume or more of the inhibitor.

In other embodiments of the present invention, additives may be included in the inhibitors of the present invention to provide additional qualities. For instance, dyes may be added to color the inhibitor to distinguish it as a high-temperature inhibitor or to provide a visual reference for ensuring coating of a component used in an electrical transmission and distribution system. Similarly, other conductive materials may be added to the high-temperature inhibitors of the present invention to provide different conductive qualities to the high-temperature inhibitor.

In embodiments of the present invention, the inhibitor is inert, allowing the inhibitor to be used with, or in proximity to, insulating materials that are commonly used with electrical transmission and distribution systems. In other words, the inhibitor does not react with insulating materials. The inert qualities of the inhibitor may be controlled through selection of the base oil and metal particles used to form the inhibitor as will be understood by those skilled in the art.

In other embodiments of the invention, a high-temperature inhibitor, such as those described above, is applied to an electrical connection device to protect the electrical connection device. In some embodiments, a method of inhibiting corrosion in an electrical connection device comprises applying an inhibitor capable of operating at a temperature above 150° C. to an electrical connection wherein the inhibitor comprises a base oil and metal particles. The inhibitor may reduce and/or prevent oxidation and/or corrosion of the electrical connection device. The inhibitor may also be used to seal the electrical connection device to protect it from the elements of nature. Inhibitors according to embodiments of the present invention may be applied to an electrical connection device to facilitate electrical connection between one or more conductors and/or electrical connection devices. For instance, the wedge device 100 illustrated in FIG. 1 may be coated with the inhibitor to protect the wedge device 100 from the elements of nature and provide an abrasive contact material for improving metal-to-metal contact between the wedge device 100 and other components of electrical transmission and distribution systems.

In some embodiments, an inhibitor may be applied to an electrical connection device prior to sale or distribution of the electrical connection device. An electrical connection device suitable for use in electrical transmission and distribution systems operating continuously at temperatures above 150° C. may comprise the electrical connection device at least partially coated with an inhibitor of the embodiments of the present invention. For instance, the wedge device 100 illustrated in FIG. 1 may be at least partially coated with an inhibitor according to various embodiments of the present invention and distributed as a coated product. Wedge devices 100 sold or provided with other components of electrical transmission and distribution systems, such as in-line disconnect assemblies, may be at least partially coated with the inhibitor prior to sale or distribution to ensure, for example, that the assembly is capable of handling or being used with high-temperature energy transmission and distribution systems. Other energy transmission and distribution system components may similarly be at least partially coated with an inhibitor prior to distribution or sale to help ensure compatibility with high-temperature energy transmission and distribution systems. For example, products used in power utility applications that may benefit from being pre-coated with inhibitors of embodiments of the present invention include, but are not limited to: taps, such as WRENCH-LOK copper taps, AMPACT copper taps, AMPACT aluminum tap systems, EXCL taps; connectors, such as aluminum connectors, MINIWEDGE connectors, Universal Distribution Connectors, SHEAR-LOK grounding connectors, aluminum grounding connectors, copper grounding connectors, and wedge splice connectors; disconnects, such as in-line disconnects, and stud disconnects; lugs, such as aluminum lugs, and copper lugs; and other electrical connection devices, such as insulation and bundling products, closures, terminals, splices, connecting plates, identifier plates, and the like.

In other embodiments, the inhibitor according to embodiments of the present invention may be used and distributed as a grease or lubricating product for use in energy transmission and distribution systems. An inhibitor according to embodiments of the invention may be distributed as a grease or lubricating product and may be applied to electrical connection devices being used in the field or to electrical connection devices being prepared for use. Further, a high-temperature inhibitor according to some embodiments of the present invention may be applied to conductors and other devices used in energy transmission and distribution systems operating at temperatures exceeding 150° C. to protect the conductors and devices from oxidation, corrosion, and/or general exposure to the elements, in addition to providing a conductive contact material for improving electrical signals. For instance, an inhibitor may be applied to the surface of a replacement wedge device 100 being installed on an in-line disconnect assembly for use in a high-temperature energy transmission and distribution system.

In other embodiments of the present invention, an electrical device and an inhibitor may be distributed together for use with an electrical transmission and distribution system. For instance, a wedge device 100 may be sold or distributed with a package of inhibitor, wherein the package of inhibitor includes a sufficient amount of inhibitor needed to at least partially coat the wedge device 100 for use in an electrical transmission and distribution system. The package of inhibitor may be opened at the time the wedge device 100 is being installed for application of the inhibitor to the wedge device 100.

Various embodiments of the present invention are intended for use in electrical transmission and distribution systems operating at temperature above 150° C. However, embodiments of the present invention may be used with electrical transmission and distribution systems operating at temperatures below 150° C. For instance, an inhibitor according to embodiments of the present invention may be applied to a wedge device 100 used in an electrical transmission and distribution system continuously operating at a temperature below 150° C. Use of an inhibitor capable of operating at temperatures greater than 150° C. with electrical transmission and distribution systems operating at lower temperatures provides added security in case the operating temperatures of the system spike above 150° C. Furthermore, electrical transmission and distribution systems employing embodiments of the present invention at low temperatures may be switched to higher operating temperatures, such as temperatures over 150° C., without first replacing all of the connectors and/or inhibitors to ensure operation at the higher temperatures.

Two particular Examples of embodiments of the present invention follow. It is understood that the Example embodiments do not limit the present invention.

EXAMPLE 1

In a first Example of embodiments of the present invention, a high-temperature inhibitor comprises about 90 percent by weight of a high-temperature base oil and about 10 percent by weight of a metal particle mixture comprising aluminum and nickel. The high-temperature base oil is UniFlor® 8623, which is commercially available from Nye Lubricants, Inc. of Fairhaven, Mass. To the base oil is added an aluminum and nickel metal particle mixture, which is mixed into the base oil to form a high-temperature inhibitor according to embodiments of the present invention. The aluminum and nickel metal particle mixture comprises about 48 to about 52 percent by weight virgin aluminum particles with mesh sizes between about −80 and about +200 and about 48 to about 52 percent by weight electrolytic grade nickel particles with mesh sizes between about −80 and about +200.

The high-temperature inhibitor of this Example may be stored for future use or applied to an electrical connection or other exposed surface in an energy transmission and distribution system to provide corrosion resistance, sealing, and/or protection from the elements. It exhibits a continuous operating temperature limit of about 260° C. and may be capable of operating at temperatures of about 320° C. for short periods of time to compensate for emergency loading needs in an energy transmission or distribution system.

EXAMPLE 2

In a second Example of embodiments of the present invention, the high-temperature inhibitor comprises about 90 percent by weight of a base oil and about 10 percent by weight of a metal particle mixture. The base oil comprises a perfluoroalkylether base oil that is thickened by a polydimethyl siloxane treated amorphous fumed silica thickener. Mixing perfluoroalkylether with the polydimethyl siloxane treated amorphous fumed silica thickener forms the base oil. The perfluoroalkylether is added in an amount of about 87.5 percent by weight of the desired inhibitor weight and the siloxane treated amorphous fumed silica thickener is added in an amount of about 4.3 percent by weight of the desired inhibitor weight. To the base oil is added a mixture of spherical aluminum and nickel metal particles. The aluminum and nickel metal particle mixture comprises about 48 to about 52 percent by weight virgin aluminium particles with mesh sizes between about −80 and about +200 and about 48 to about 52 percent by weight electrolytic grade nickel particles with mesh sizes between about −80 and about +200.

The high-temperature inhibitor of this Example may also be stored for future use or applied to an electrical connection or other exposed surface in an energy transmission and distribution system to provide corrosion resistance, sealing, and/or protection from the elements. It exhibits a continuous operating temperature range of between about −40° C. and about 260° C. It is also capable of operating at temperatures of about 320° C. for short periods of time to compensate for emergency loading needs in an energy transmission or distribution system.

Having thus described certain preferred embodiments of the present invention, it is to be understood that the invention defined by the appended claims is not to be limited by particular details set forth in the above description as many apparent variations thereof are possible without departing from the spirit or scope thereof as hereinafter claimed.

What is claimed is:

1. An inhibitor, comprising:

a base oil capable of operating at a temperature above 150° C., wherein the base oil comprises at least one fluorinated base oil; and metal particles in the base oil.

2. The inhibitor of claim 1, wherein the base oil comprises at least one base oil capable of operating at a temperature of about 200° C.

3. The inhibitor of claim 1, wherein the base oil comprises at least one base oil capable of operating at a temperature of about 250° C.

4. The inhibitor of claim 1, wherein the base oil is stable at an operating temperature of about 250° C.

5. The inhibitor of claim 1, wherein the base oil is stable at an operating temperature of about 320° C.

6. The inhibitor of claim 1, wherein the base oil comprises at least one fluorinated base oil selected from the group consisting of fluorinated ether, perfluoropolyether, perfluoroalkyether, perfluoroalkylether, and combinations thereof.

7. The inhibitor of claim 1, wherein the base oil comprises:

a perfluoroalkyether; and a thickener.

8. The inhibitor of claim 7, wherein the thickener comprises a polydimethyl siloxane treated amorphous fumed silica.

9. The inhibitor of claim 7, wherein the perfluoroalkyether comprises about 87.5 weight percent of the fluorinated base oil.

10. The inhibitor of claim 7, wherein the thickener comprises about 4.3 weight percent of the fluorinated base oil.

11. The inhibitor of claim 1, wherein the base oil comprises about 90 weight percent of the inhibitor.

12. The inhibitor of claim 1, wherein the base oil comprises a UniFlor® lubricant.

13. The inhibitor of claim 1, wherein the metal particles comprise at least about 10 weight percent of the inhibitor.

14. The inhibitor of claim 1, wherein the metal particles comprise between about 10 weight percent and about 30 weight percent of the inhibitor.

15. The inhibitor of claim 1, wherein the metal particles comprise metal particles with a standard mesh size of between about −80 mesh and about +200 mesh.

16. The inhibitor of claim 1, wherein the metal particles comprise nickel.

17. The inhibitor of claim 1, wherein the metal particles comprise aluminum.

18. The inhibitor of claim 1, wherein the metal particles comprise metal particles selected from the group consisting of lead, tin, bismuth, and mixtures thereof.

19. The inhibitor of claim 1, wherein the metal particles comprise:

nickel particles; and aluminum particles.

20. The inhibitor of claim 19, wherein the nickel particles comprise electrolytic grade nickel.

21. The inhibitor of claim 19, wherein the nickel particles comprise about 50 weight percent of the metal particles.

22. The inhibitor of claim 19, wherein the nickel particles comprise between about 48 weight percent and about 52 weight percent of the metal particles.

23. The inhibitor of claim 19, wherein the nickel particles comprise nickel particles wit a standard mesh size between about −80 mesh and about +200 mesh.

24. The inhibitor of claim 19, wherein the aluminum particles comprise virgin aluminum.

25. The inhibitor of claim 19, wherein the aluminum particles comprise about 50 weight percent of the metal particles.

26. The inhibitor of claim 19, wherein the aluminum particles comprise between about 48 weight percent and about 52 weight percent of the metal particles.

27. The inhibitor of claim 19, wherein the aluminum particles comprise aluminum particles with a standard mesh size between about −80 mesh and about +200 mesh.

28. The inhibitor of claim 1, wherein the high-temperature inhibitor is inert.

29. The inhibitor of claim 1, further comprising non-conductive particles.

30. The inhibitor of claim 29, wherein the non-conductive particles are selected from the group consisting of oxides, alumina, and mixtures thereof.

31. An electrical connection device, comprising:

an inhibitor capable of operating at a temperature of at least 150° C.; and an electrical connection device at least partially coated with the inhibitor.

32. The electrical connection device of claim 31, wherein the inhibitor comprises:

at least one base oil capable of operating at a temperature of at least 150° C.; and particles mixed in the at least one base oil.

33. The electrical connection device of claim 32, wherein the at least one base oil comprises at least one base oil selected from the group consisting of fluorinate ether, perfluoropolyether, perfluoroalkyether, perfluoroalkylether, and combinations thereof.

34. The electrical connection device of claim 32, wherein the at least one base oil comprises at least one thickener.

35. The electrical connection device of claim 32, wherein the at least one base oil is stable at about 250° C.

36. The electrical connection device of claim 32, wherein the particles comprise metal particles.

37. The electrical connection device of claim 32, wherein the particles comprise particles selected from the group consisting of oxides, alumina, and mixtures thereof.

38. The electrical connection device of claim 32, wherein the particles comprise conductive particles selected from the group consisting of aluminum, nickel, lead, tin, bismuth, alloys of any of the foregoing metals, and mixtures thereof.

39. The electrical connection device of claim 32, wherein the inhibitor comprises between about 70 and about 90 weight percent of the at least one base oil and between about 10 and about 30 weight percent of the particles.

40. The electrical connection device of claim 32, wherein the inhibitor comprises between about 0 and about 30 percent by volume of the particles.

41. The electrical connection device of claim 34, wherein the electrical connection device comprises an electrical connection device used wit energy transmission and distribution systems.

42. The electrical connection device of claim 34, wherein the electrical connection device comprises an electrical connection device selected from the group consisting of taps, connectors, lugs, disconnects, and connecting plates.

43. The electrical connection device of claim 42, wherein the taps comprise taps selected from the group consisting of WRENCH-LOK copper taps, AMPACT copper taps, AMPACT aluminum tap systems, and EXCL taps.

44. The electrical connection device of claim 42, wherein the connectors comprise connectors selected from the group consisting of aluminum connectors, MINIWEDGE connectors, Universal Distribution Connectors, aluminum grounding connectors, copper grounding connectors, and SHEAR-LOK grounding connectors.

45. The electrical connection device of claim 42, wherein the disconnects comprise disconnects selected from the group consisting of in-line disconnects and stud disconnects.

46. A method of inhibiting corrosion in an electrical connection, comprising:

applying an inhibitor to the electrical connection, wherein the inhibitor comprises a base oil with a stable operating temperature of at least about 150° C. mixed with metal particles.

47. The method of claim 46, wherein the base oil comprises at least one base oil selected from the group consisting of fluorinated ether, perfluoropolyether, perfluoroalkyether, perfluoroalkylether, and combinations thereof.

48. The method of claim 46, wherein the base oil comprises at least one base oil with a stable operating temperature above about 150° C.

49. The method of claim 46, wherein the metal particles comprise metal particles selected from the group consisting of aluminum, nickel, lead, tin, bismuth, alloys of any of the foregoing metals, and mixtures thereof.

50. The method of claim 46, wherein the electrical connection comprises an electrical connection selected from the group consisting of taps, WRENCH-LOK copper taps, AMPACT copper taps, AMPACT aluminum tap systems, EXCL taps, aluminum connectors, MINI WEDGE connectors, Universal Distribution Connectors, insulation products, bundling products, closures, terminals, splices, aluminum grounding connectors, copper grounding connectors, SHEAR-LOK grounding connectors, aluminum lugs, copper lugs, in-line disconnects, scud disconnects, wedge splice connectors, connecting plates, and identifier plates.

51. An electrical connection kit, comprising:

an electrical connector; and an inhibitor comprising a base oil capable of operating at a temperature above 150° C. mixed with metal particles.

52. The electrical connection kit of claim 51, wherein the inhibitor is partially coating the electrical connector.

53. The electrical connection kit of claim 51, wherein the inhibitor is provided separately from the electrical connector.

54. The electrical connection kit of claim 51, wherein the base oil comprises at least one base oil selected from the group consisting of fluorinated ether, perfluoropolyether, perfluoroalkyether, perfluoroalkylether, and combination thereof.

55. An inhibitor, comprising:

between about 70 and about 90 weight percent of at least one base oil capable of operating between 150° C. and about 250° C.; and between about 10 and about 30 weight percent of particles suspended in the at least one base oil.

56. The inhibitor of claim 55, wherein the at least one base oil comprises at least one fluorinated base oil selected from the group consisting of fluorinated ether, perfluoropolyether, perfluoroalkyether, perfluoroalkylether, and combinations thereof.

57. The inhibitor of claim 55, wherein the particles comprise particles selected from the group consisting of metal particles and non-metallic particles.

58. An electrical connection device, comprising:

an inhibitor including at least one fluorinated base oil capable of operating at a temperature above 150° C. and metal particles in the fluorinated base oil; and an electrical connector at least partially coated with the inhibitor.

59. The electrical connection device of claim 58, wherein the electrical connector comprises at least one of an aluminum connector or an aluminum grounding connector.

* * * * *